United States Patent [19]

Gordon

[11] 4,245,838

[45] Jan. 20, 1981

[54] POLE VAULTING LANDING PIT

[75] Inventor: Donald W. Gordon, Yorba Linda, Calif.

[73] Assignee: Nissen Corporation, Cedar Rapids, Iowa

[21] Appl. No.: 24,555

[22] Filed: Mar. 28, 1979

[51] Int. Cl.[3] ..... A63B 5/00

[52] U.S. Cl. ..... 272/104; 272/101

[58] Field of Search ..... 5/420, 448; 182/137; 272/93, 109, 101-105; 273/55 R, 55 A, 55 D

[56] References Cited

U.S. PATENT DOCUMENTS

| | | | |
|---|---|---|---|
| 814,654 | 3/1906 | Kee | 5/420 X |
| 1,897,521 | 2/1933 | Lagarde | 5/448 X |
| 2,143,122 | 1/1939 | Dawson | 182/137 |
| 2,360,715 | 10/1944 | Perry | 5/448 |
| 2,652,966 | 9/1953 | Griswold | 272/65 X |
| 2,945,550 | 7/1960 | Andreasen | 182/137 |
| 3,026,544 | 3/1962 | Persicke et al. | 5/448 X |
| 3,242,509 | 3/1966 | Nissen | 272/109 X |
| 3,262,134 | 7/1966 | Bramble | 5/448 |
| 3,319,273 | 5/1967 | Solin | 5/420 |
| 3,362,032 | 1/1968 | Summers | 5/448 |
| 3,369,808 | 2/1968 | Sconce | 272/101 |
| 3,494,615 | 2/1970 | Moore | 272/105 |
| 3,513,491 | 5/1970 | Gordon | 5/420 |
| 3,526,911 | 9/1970 | Meyer et al. | 5/420 |
| 3,682,476 | 8/1972 | Kempson | 273/55 R X |
| 3,782,724 | 1/1974 | Rottman et al. | 273/55 R |
| 3,851,730 | 12/1974 | Scurlock | 182/137 |
| 3,879,777 | 4/1975 | Walker | 5/448 |
| 3,892,401 | 7/1975 | Sorenson | 272/101 |
| 3,892,402 | 7/1975 | Montour et al. | 272/101 |
| 3,965,507 | 6/1976 | Reiland | 272/104 |
| 4,057,245 | 11/1977 | Gordon | 272/101 |
| 4,068,739 | 1/1978 | Gordon et al. | 182/137 X |
| 4,089,519 | 5/1978 | Newton | 272/105 |

FOREIGN PATENT DOCUMENTS

| | | | |
|---|---|---|---|
| 665548 | 5/1929 | France | 5/448 |
| 1324907 | 3/1963 | France | 5/448 |
| 174995 | 4/1961 | Sweden | 5/448 |

OTHER PUBLICATIONS

"1977 Landing Pit Catalog", by D. W. Gordon Inc.

*Primary Examiner*—Richard J. Apley
*Attorney, Agent, or Firm*—Knobbe, Martens, Olson, Hubbard & Bear

[57] ABSTRACT

An improved above ground landing pit particularly suitable for pole vaulting events is disclosed wherein the frontal portion of the pit includes an opening which surrounds the plant box having an angularly inclined back wall to accommodate the substantial flexure of the vaulting pole during the vault. The sidewalls of the pit are additionally provided with a tapered recess adjacent the lower edge thereof which permits the upper portion of each sidewall to extend in a cantilevered manner over the respective post standard thereby preventing injury to the athlete. Further, the present invention discloses a unique post standard which is exclusively anchored in position by the weight of the pit yet permits the post to be selectively positioned relative the length of the pit.

4 Claims, 4 Drawing Figures

Fig. 1
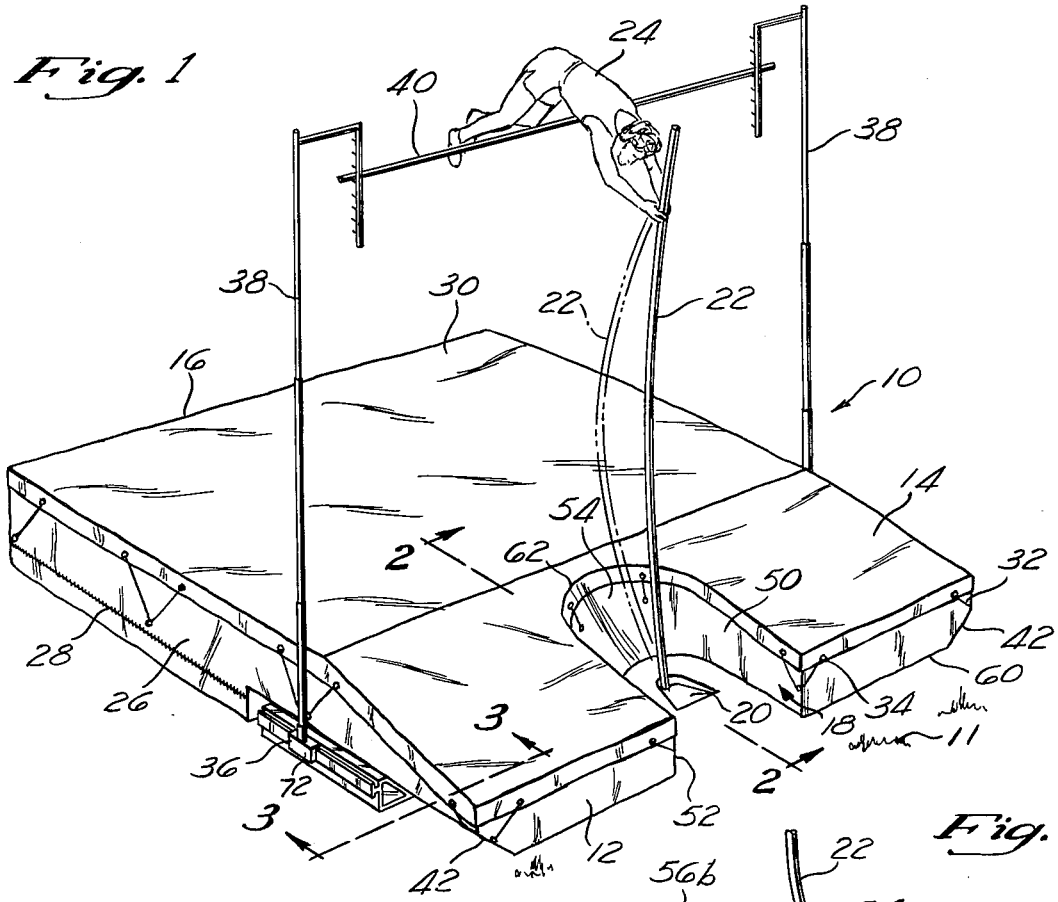
Fig. 2
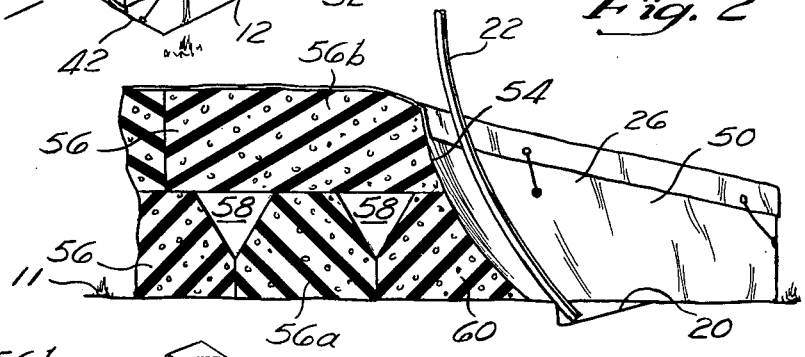
Fig. 3
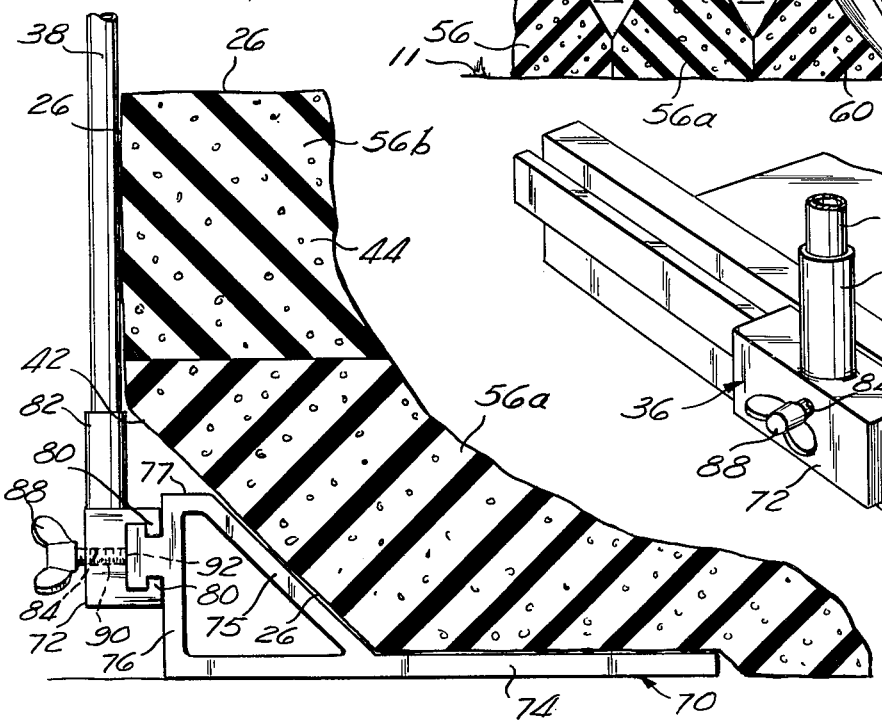
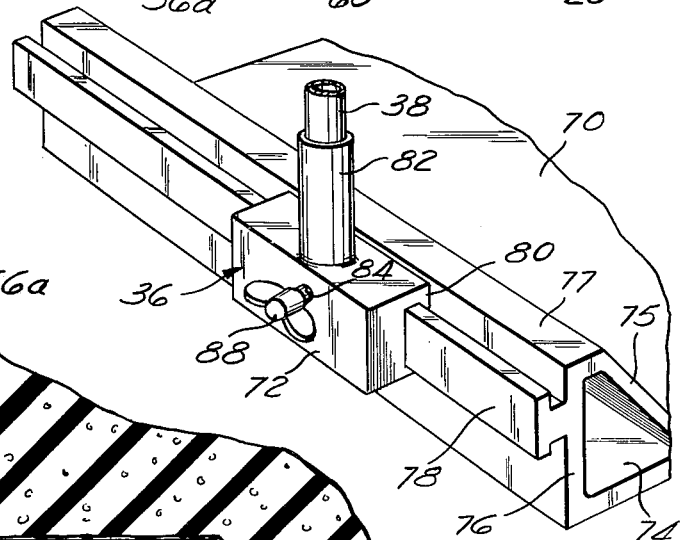
Fig. 4

POLE VAULTING LANDING PIT

BACKGROUND OF THE INVENTION

The present invention relates to pole vaulting landing pits and more particularly to above ground pole vaulting landing pits constructed of a plurality of foam logs which deform upon impact to safely absorb the momentum of a falling athlete.

In recent years, the most extensively utilized above ground athletic landing pits have been those constructed of stiff foam blocks or logs arranged in a brick-like lattice structure in accordance with the teachings of my prior U.S. Pat. No. 3,513,491 issued May 26, 1970 and my co-pending patent application Ser. No. 651,674, filed Jan. 23, 1976, the disclosures of which are expressly incorporated herein by reference. Such foam log landing pits have proven to be a significant improvement over the sawdust and scrap-foam filler bags heretofore utilized in the athletic field due to their superior cushioning effect, extremely portable nature, increased durability, and pleasing asthetics.

However, even though my previous landing pit devices have been extremely beneficial in general use, there are deficiencies associated in their specific pole vaulting applications. These deficiencies have been primarily due to their inability to accommodate the substantial deflection of the vaulting pole adjacent the plant box and their failure to adequately protect the athlete against accidental falls upon the post standards disposed on opposite sides of the pit.

As is well known, fiberglass vaulting poles are typically utilized by athletes in pole vaulting events which, when inserted into the plant box, substantially flex into a curvilinear configuration in response to bearing the athlete's weight and horizontal momentum. As the athlete rises upward, the internal resiliency of the fiberglass causes the vaulting pole to rapidly return to its initial linear configuration, thereby providing a slingshot effect which aids in propelling the athlete over the crossbar.

My prior art landing pit devices have heretofore been constructed with a small cutout portion or opening adjacent the front end thereof, which surrounds the plant box, having substantially planar sidewalls oriented perpendicular to the ground. To provide the maximum protection to the athlete, the positioning of this cutout must be maintained extremely close to the plant box such that, in the event of a short vault by the athlete, the pit will prevent the athlete from falling directly upon the exposed plant box.

However, it has been found that, due to this close positioning of the sidewalls of the opening to the plant box, the vaulter's pole often contacts the rear wall of the opening during the vault. Although the resilient foam of the pit deforms upon this contact, it tends to reduce the magnitude of the vaulting pole flexure during the vault, which in sophisticated competition, may determine the ultimate outcome of the event. A few prior art designs have recognized this deficiency and have included a slight bevel along the top edge of the rear wall of the opening. However, due to the substantial pole flexure encountered during the vault, this small bevel has proven ineffectual in eliminating pole contact with the pit. Hence, many athletes, when using my prior pit designs, position the cutout or opening at a location removed from the plant box which exposes the athlete to an increased safety risk.

Additionally my previous pits, as well as other prior art landing pits, have failed to completely shield the athlete against accidental contact with the post standards located adjacent opposite sides of the landing pit. Typically, post standards are constructed as a rectangular flat plate formed of heavy metal or wood, onto which the vertical post utilized to support the crossbar is rigidly mounted. The standards may be freestanding or, alternatively, be mounted upon a pair of rails anchored upon the ground, either design of which permits the athlete to selectively position the posts along the length of the pit relative the plant box.

Due to the standardization within the sport, these vertical posts, and thus their respective mounting standards, must be separated from one another at a precise distance. Heretofore the prior art landing pits have been sized to precisely fit between the vertical posts which has caused a portion of the standards to extend outwardly and be exposed adjacent the sides of the pit. This direct exposure of a portion of the post standards has posed a significant safety hazard to both the experienced and inexperienced athlete, who occasionally drift laterally during a vault and land upon the post standards.

Although this safety hazard could be decreased by wrapping the post standards with a padding material, such wrapping would fail to provide an adequate cushioning effect and, additionally, may significantly prohibit the selective positioning of the standard along the length of the pit.

Thus, there exists a need for an improved pole vaulting landing pit which can accommodate the substantial flexure of the vaulting pole while preventing direct contact of the athlete with the plant box and completely shielding the post standards from the athlete while permitting the selective positioning of the standards along the length of the pit.

SUMMARY OF THE PRESENT INVENTION

The present invention provides an improved pole vaulting landing pit which significantly eliminates the above-referenced deficiencies associated in the prior art. This result is accomplished in part by forming the opening of the landing pit surrounding the plant box to include an angularly inclined curvilinear rear wall which accommodates the substantial deflection of the vaulting pole during use.

By this curvilinear rear or back wall design, the upper portion of the pit is cleared to allow the vaulter's pole to freely flex without contacting the pit, whereas the lower portion of the pit remains proximal the plant box, thereby providing a moderate cushion for the athlete upon an accidental short vault. Thus, by way of the curvilinear back wall of the improved landing pit of the present invention, the substantial deflection of the vaulter's pole is accommodated without posing a significant increase in the safety hazard to the athlete.

Additionally, the improved landing pit of the present invention includes a predominant tapered recess adjacent two of its lower edges which provides the landing pit with a cantilevered sidewall design. These cantilevered sidewalls advantageously extend outward over the post standards, thereby shielding the athlete from any accidental contact therewith. As such, possible injury to the athlete is substantially reduced even in the event of an improper vault.

The present invention further incorporates a unique post standard formed by an L-shaped plate member, the longest leg of which extends substantially beneath the width of the landing pit and is maintained stationary the the weight of the pit while the shorter leg rises vertically to reside exclusively beneath the cantilevered sidewalls. The shorter leg of the plate preferably includes a T-shaped rail adjacent its outboard side extending throughout the length thereof, which mates with a pair of flanges formed on a mounting plate rigidly attached to the lower end of the vertical post member. The rail and flange form a tongue and groove assembly which permits the vertical posts to be selectively positioned along the length of the pit, merely by sliding the mounting plate horizontally along the rails.

Thus, the cantilevered sidewalls and unique post standards of the present invention provide a significant improvement over the prior art landing pit devices by allowing the vertical posts to be selectively positioned by an athlete relative the plant box while the standard remains shielded beneath the sidewalls of the pit.

Additionally, the present invention provides a quick connect and disconnect means for rigidly fastening the vertical posts upon the standard which significantly decreases setup time required for each athlete during athletic competition. Thus, as will be recognized throughout the disclosure, the present invention permits an athlete to obtain the greatest performance in the pole vaulting event, yet maintain the highest degree of safety.

DESCRIPTION OF THE DRAWINGS

These and other features of the present invention will become more apparent upon reference to the drawings wherein:

FIG. 1 is a perspective view of the improved landing pit of the present invention, showing the curvilinear back wall of the plant box opening and the post standards recessed beneath the cantilevered sidewalls of the pit;

FIG. 2 is a cross-sectional view taken about lines 2—2 of FIG. 1 depicting the manner in which the curvilinear back wall of the plant box opening accommodates the substantial flexure of the vaulting pole and further illustrating the particular foam log construction of the pit;

FIG. 3 is an enlarged cross-sectional view of the cantilevered sidewalls of the pit of the present invention and the improved post standards residing there beneath taken about lines 3—3 of FIG. 1; and FIG. 4 is an enlarged perspective view of the post standards of the present invention, depicting the means for selectively fastening the vertical post standards thereon.

DETAILED DESCRIPTION OF THE PREFERRED EMBODIMENT

Referring to FIG. 1, there is shown the improved landing pit 10 of the present invention composed generally of a frontal portion 12, preferably having an inclined upper surface 14 and an aft poriton 16, possessing a substantially rectangular configuration. The frontal portion 12 is provided with an opening 18 closely positioned adjacent a plant box 20, which receives one end of a vaulting pole 22 utilized by an athlete 24 during the vault. The opening 18 is sized to permit the frontal portion or apron 12 of the pit 10 to extend forward of the leading edge of the plant box 20, thereby, in effect, surrounding the plant box 20. Further, as shown, the opening 18 includes an angularly inclined curvilinear rear wall 54, which, as will be described in more detail below, permits the vaulting pole 22 to freely flex in response to the momentum and weight of the athlete 24 without contacting the pit 10.

In conformity with my previously referenced patent and patent application, the frontal and aft portions 12 and 16, respectively, of the pit 10 are interconnected to form a composite structure by way of a flexible casing 26 which envelopes the pit 10, being selectively closed by a zipper 28 extending along three sides thereof. This casing 26 is preferably water impervious yet constructed of a breather material which allows air trapped within the casing 26 to be vented upon deformation of the pit 10 by the athlete 24.

To further protect the pit 10 from degradation caused by incident ultraviolet sun rays as well as track cleats of the athlete's footwear, an additional layer of breather material 30 is preferably disposed over the top surface of the casing 26. As shown, this cover or layer 30 is retained in position by a plurality of elastic straps 32 which are connected between a series of eyelets 34 formed on the edges of both the cover 30 and casing 26.

As is typical, a pair of post standards 36 are disposed adjacent opposite sidewalls of the pit 10, each supporting a vertical post 38 which balances a crossbar 40 in a manner well known in the art. However, in contrast to the prior art standards, the standard 36 of the present invention resides within a tapered recess 42 formed adjacent the lower edge of the pit 10. As will be explained in more detail infra, this recess 42 forms a cantilevered sidewall design for the pit 10 of the present invention which effectively shields the athlete 24 from any accidental contact with the standard 36 while permitting each of the vertical posts 38 to be selectively positioned along the length of the standard 36 relative the plant box 20.

Referring jointly to FIGS. 1 and 2, the detailed construction of the pit 10 and the opening 18 formed in the frontal portion 12 thereof, may be described. In accordance with the teachings of my previously referenced copending patent application, the pit 10 is formed from a plurality of foam blocks or logs 56 preferably having a trapezoidal cross-sectional configuration which are arranged in a dual tier orientation within the casing 26.

As shown, adjacent logs 56 are arranged in a side-by-side manner on both the upper and lower tier, with the lower tier preferably being oriented peripendicular to the upper tier. By such an arrangement, plural triangular-shaped voids 58 are formed within the interior of the pit 10 which the applicant has found yield maximum resilience to the landing pit 10. It should be noted, however, that other alternative cross-sectional configurations and orientation of the logs within the pit 10 may be utilized without departing from the spirit of the present invention.

The opening 18 of the pit 10 of the present invention is formed having a pair of sidewalls 50 and 52, respectively, which extend substantially throughout the length of the frontal portion 12 and terminate at their intersection with the rear wall 54. In the preferred embodiment, the sidewalls 50 and 52 are positioned proximal the plant box 20 adjacent the lower surface 60 of the pit 10 and extend substantially normal therefrom, whereas the rear wall 54, although initiating along the lower surface 60 at a location proximal the plant box 20, extends along a curvilinear path away from the plant box 20, terminating in a cylindrical edge 62.

It will be recognized that, due to this curvilinear rear wall 54, the upper portion of the pit 10 disposed adjacent the plant box 20 is cleared to allow the vaulting pole 22 to freely flex without contacting the pit 10, while the lower portion of the rear wall remains proximal the plant box 20. Further, in the preferred embodiment, the radius of curvature of the rear wall is sized to approximate the magnitude of flexure typically encountered in the fiberglass vaulting pole 22.

The particular curvilinear configuration of the rear wall 54 is preferably facilitated by the removal or dishing out of a portion of the outermost foam logs 56A and 56B of the lower and upper tiers, respectively, which the applicant has found to be easily accomplished during manufacture of the pit 10. However, it will be recognized that, alternatively, standard square end foam blocks 56 may be spaced inboard from the rear wall 54 of the opening 18 and additional foam padding (not shown) may be selectively inserted adjacent the ends of the foam logs 56A and 56B to manually build up the area adjacent the rear wall 54.

Due to the recessed curvilinear rear wall 54, the landing pit 10 of the present invention readily accommodates the substantial flexure of the vaulting pole 22 during the vault, thereby permitting the athlete 24 to obtain the maximum performance characteristics from the pole 22 and thus the maximum height for a particular vault. Additionally, because the respective sidewalls 50 and 52, as well as the lower portion of the rear wall 54, remain proximal the plant box 20, with the frontal portion 12 extending forward of the plant box 20, the exposed area adjacent the plant box 20 is maintained at a minimum, thereby reducing the possibility of an athlete landing directly upon the plant box in the event of a short vault. As such, the angularly inclined curvilinear rear wall 54 of the present invention permits an athlete to obtain the greatest performance in a pole vaulting event yet maintain the highest standard of safety.

To augment the increased performance and safety characteristics made possible by the curvilinear rear wall 54, the present invention, as previously mentioned, incorporates a cantilevered sidewall design which completely isolates or shields the post standards 36 from the athlete 24.

Referring to FIGS. 1 and 3, it may be seen that two of the lower edges of the pit 10 are provided with a tapered recess 42 which, in the preferred embodiment, is formed by the removal of a portion of each of the foam logs 56A disposed adjacent the sides of the pit 10. Preferably, the recess 42 is inclined at an approximate 45-degree angle extending substantially throughout the height of the log 56A, i.e., approxiamtely one-half the total heighth of the pit 10. The applicant has found that this 45° inclination of the recess 42 facilitates the placement of the post standard 36 to reside beneath the recess 42, yet provides adequate support for the upper portion 44 of the sidewall to prevent sagging thereof during use.

Therefore, it may be recognized that the recess 42 forms, in effect, a cantilevered sidewall design which permits the post standard 36 to be located or reside beneath the tapered recess 42 while the upper portion 44 of the sidewall extends upward and outboard of the standard 36. Thus, the standard 36 is virtually entirely covered by a portion of the pit 10 of the present invention to effectively shield the athlete from any accidental contact with the standard 36 during use. As such, in the event of an improper vault, any possible injury to the athlete is substantially reduced.

For use in combination with the cantilevered sidewalls, the present invention further includes a unique post standard 36 which may be easily positioned to reside beneath the tapered recess 42 of the pit 10, and additionally permit the athlete to selectively adjust the position of the vertical post 38 relative the plant box 20.

As shown in FIGS. 3 and 4, the post standard 36 is composed generally of an L-shaped plate member 70 and slider mount 72 which are both typically formed of aluminum or steel. The length of the plate member 70 may be formed to any convenient size; however, in the preferred embodiment, it is sized slightly less than the length of the tapered recess 42 of the pit 10, such that the plate member 70 does not extend beyond the frontal end of the pit 10.

The plate member 70 is formed of two leg members 74 and 76, which are oriented substantially perpendicular to one another. The shorter leg 76 is sized to reside beneath the tapered recess 42 of the pit 10, and is preferably provided with an angularly inclined strut 75 which extends from the top edge 77 of the leg 76 and is rigidly connected at its lower end to the lower leg 74. This strut 75 maintains the vertical orientation of the shorter leg 76 as well as providing a smooth support surface for the recess 42 which reduces the possibility of tearing or puncturing the casing 26 during use. The length of the longer leg 74 of the plate member 70 is sufficient to extend substantially beneath the lower portion of the pit 10 inboard of the recess 42 (as shown in FIG. 3). Due to this extension of the leg member 74 beneath the pit 10, the plate member 70 is maintained in its proper position exclusively by the weight of the landing pit 10, thereby eliminating the necessity of utilizing anchor members to rigidly affix the plate member to the ground 11.

In the preferred embodiment, the shorter leg 76 of the plate member 70 is additionally provided with a T-shaped rail 78 positioned approximtely midway along its heighth and extending throughout its length. As shown in FIG. 4, this rail 78 cooperates with a pair of L-shaped flanges 80 which extend adjacent one side of the slider mount 72. The flanges 80 are spaced from one another at a distance slightly greater than the extreme width of the T-shaped rails 78 so that the slider mount 72 may slidingly travel along the length of the rail 78.

As will be recognized, the rail 78 and flange 80 thereby provide a tongue and groove assembly for the slider plate 72 which positively registers the slider plate 72 with the L-shaped plate member 70, yet permits the slider plate to be easily located at any position along the length of the rail 78.

The slider plate 72 includes a tubular extension 82 rigidly mounted adjacent its top surface, which telescopingly receives the lower end of the vertical post member 38. The inside diameter of the extension 82 is sized to tightly mate with the outside diameter of the vertical post member 38 to prevent any non-axial movement between the diameter interface which would cause the vertical post 38 to deflect at its opposite end.

In the preferred embodiment, the slider mount 72 is additionally provided with a threaded aperture 84 which is centrally located on the outboard side thereof and oriented perpendicular to the leg 76 of the plate member 70. This threaded aperture 84 receives a wing-nut 88 having a mating threaded shank 90. As will be recognized, by selectively threading the fastener 88 into the threaded aperture 84, the end 92 of the shank 90 bears against the top surface of the rail 78 causing the slider mount 72 to be tightly clamped along the length of the rail 78, thereby preventing any accidental movement of the slider plate 72 relative the rail 78 during the vault.

Referring to FIG. 3, it may be seen that, by use of the cantilevered sidewall design of the present invention in combination with the particular standard 36 disclosed herein only the vertical post 38, a portion of the slider mount 72, and the wing fastener 88 extend beyond the sidewalls of the pit 10, while the plate member 70 and most of the slider mount 72 reside exclusively beneath the tapered recess 42 formed along the lower edge of the landing pit 10. As such, the athlete 24 is completely shielded from any accidental contact with the standard 36 which could occur in the event of an improper vault.

Thus, from the above disclosure, it will be recognized that the present invention provides a substantially improved pole vaulting landing pit which, due to the curvilinear rear wall 54, cantilevered sidewalls 44, post standards 36, and forward extending frontal portion 12, permits maximum performance during the vault while maintaining the highest safety standards for the athlete.

It should be noted that, although the specific cantilevered sidewall configuration of the present invention has been described in combination with the improved post standards disclosed herein, this cantilevered sidewall feature is effective in preventing injuries to the athlete even when utilized in combination with the typical prior art standards. Additionally, it will be recognized that, although in the preferred embodiment a curvilinear rear wall 54 for the opening 18, a tapered sidewall 42, and T-shaped rail member has been utilized, other similar configurations may be utilized without departing from the spirit of the present invention.

I claim:

1. A landing pit for preventing injury to an athlete, comprising:

a pair of vertical posts;

a horizontal jump clearance bar supported on said vertical posts;

a pair of standards supporting said pair of posts;

a cushion positioned between said pair of vertical posts and safely absorbing the vertical fall of an athlete;

said cushion having a pair of opposite sidewalls each including a recess formed adjacent their lower edge, said recess forming a portion of each sidewall which extends over each of said standards; and at least one of said pair of standards comprising;

an L-shaped plate member having a first portion extending laterally beneath said cushion and a second portion extending substantially normal to said first portion positioned adjacent a respective one of said opposite sidewalls of said cushion;

rail means mounted on one side of said second portion of said plate member;

a mounting member slidingly mounted on said rail means including means for supporting one of said pair of vertical posts thereon; and said rail means permitting said one of said pair of vertical posts to be selectively positioned along the length of said second portion of said plate member.

2. The landing pit of claim 1 wherein said mounting member includes means to releasably clamp said mounting member at a selective position along the length of said rail means.

3. The landing pit of claim 2 wherein said clamping means comprises a threaded fastener insertable within a mating aperture formed in said mounting member .

4. The landing pit of claim 1 wherein said rail means comprises a T-shaped rail which mates with a pair of L-shaped flanges formed on said mounting member.

* * * * *